United States Patent [19]

Vyprachticky

[11] Patent Number: 4,787,361

[45] Date of Patent: Nov. 29, 1988

[54] ARCHERY BOW WITH SELF-ALIGNING COMBINATION HANDGRIP AND FOREARM PROTECTOR

[76] Inventor: Emil Vyprachticky, 7713 Webster Way, Arvada, Colo. 80004

[21] Appl. No.: 6,962

[22] Filed: Jan. 27, 1987

[51] Int. Cl.[4] ..... F41B 5/00

[52] U.S. Cl. ..... 124/88; 124/89; 124/24 R; 16/235

[58] Field of Search ..... 124/88, 86, 23 R, 24 R, 124/90, 89; 16/364, 260, 355, 264, 235, 239, 382, 387

[56] References Cited

U.S. PATENT DOCUMENTS

| | | | |
|---|---|---|---|
| 213,851 | 4/1879 | Streeter | 124/24 R |
| 218,079 | 7/1879 | Streeter | 124/90 |
| 2,900,973 | 8/1959 | Diehr | 124/24 R |
| 3,171,397 | 3/1965 | Daly | 124/24 R |
| 3,517,658 | 6/1970 | Shurts | 124/23 R |
| 3,599,621 | 8/1971 | Scrobell | 124/88 |
| 3,623,468 | 11/1971 | Crest | 124/24 R |
| 3,698,375 | 10/1972 | Brougham | 124/24 R |
| 3,834,368 | 9/1974 | Geiger | 124/23 R |
| 4,027,645 | 6/1977 | Damron | 124/24 R |
| 4,343,286 | 8/1982 | Thacker | 124/24 R |
| 4,457,287 | 7/1984 | Babington | 124/23 R |

*Primary Examiner*—Richard C. Pinkham
*Assistant Examiner*—Mark S. Graham
*Attorney, Agent, or Firm*—Edwin L. Spangler, Jr.

[57] ABSTRACT

This invention relates to an archery bow characterized by a combination handgrip and forearm protector hingedly attached in closely-spaced parallel relation to the longitudinal axis of the bow defined by the limbs of the latter and the bowstring, the handgrip-forming portion of the combination unit extending laterally out to the side and rearwardly relative to the forearm-protecting portion so as to define an acute angular relationship therebetween. The handgrip and protector cooperate with one another to prevent rotation of the forearm holding the bow while at the same time concentrating the force exerted on the handgrip at the apex of the included angle therebetween which lies closely adjacent the hinge axis thereby causing the force applied by the protector against the forearm to be minimized. The counterrotating forces exerted by the bow-holding hand on the handgrip and the forearm on the protector cancel one another out and bring about an equilibrium condition in which, with the bowstring drawn to launch an arrow, all elements of the assembly move together as a unit while aligning the arrow with the target, all without any twisting torque being applied or even appliable to the bow.

11 Claims, 2 Drawing Sheets

ARCHERY BOW WITH SELF-ALIGNING COMBINATION HANDGRIP AND FOREARM PROTECTOR

BACKGROUND OF THE INVENTION

Shooting a longbow, recurved bow or compound bow as opposed to a crossbow has always had the problem of the bowstring striking and chafing the archer's forearm as he or she releases the arrow toward the target. Forearm protectors of one type or another are, therefore, almost universally used, some independent of the bow while others comprise an integral accessory as will be explained in more detail presently in connection with a discussion of the related art.

Even with the forearm properly protected, there are other problems that need to be reckoned with and these have to do primarily with accuracy. If the bowstring and the arrow nocked thereon are permitted to strike the archer's arm in the manner noted above, the flight of the arrow is thrown to one side causing erratic flight and a loss in accuracy. On the other hand, if one bends the arm to take the forearm out of the way of the bowstring, a sidewise moment is introduced that pushes the bow in a direction other than in parallel relation to the flight of the arrow toward its target. A torque factor also enters the picture as the hand holding the bow tends to twist the latter as the arrow is released.

In addition to protecting the forearm, there is a need for it to be stabilized and prevented from rotating. While holding the bow with the hand, it still remains possible to rotate the forearm a quarter of a turn or so and this has a definite effect upon the flight of the arrow. Some skilled archers can, of course, hold the bow such that their forearms are in exactly the same position on each shot but this is the exception rather than the rule and most people find this very difficult to do.

Another problem has to do with holding the arrow against the arrow rest carried by the bow. Ordinarily the index finger of the hand holding the bow is raised up and placed alongside the arrow to hold it in proper position both against the side of the bow and on top of the arrow rest until just prior to its being released, but, this is a very awkward thing to have to do with the bow-holding hand in vertical position which is usually its attitude.

Last but by no means least is the common conception or misconception that the hand holding the bow must, for all practical purposes, grip the latter so as to be more or less aligned with the arrow rather than displaced off to one side thereof if the erratic and inaccurate flight of the arrow experienced by many archers is to be avoided.

FIELD OF THE INVENTION

The field to which the present invention relates is, therefore, the improvement in the design of an archery bow for the purpose of increasing its accuracy while, at the same time, protecting and stabilizing the forearm of the user by affixing to the bow a pivoted combination handgrip and forearm rest in which, even though the handgrip is offset and projects outwardly at essentially right angles to the longitudinal axis of the bow on the same side of the latter as the arrow rest, nevertheless, results in true and stable flight of an arrow launched therefrom.

DESCRIPTION OF THE RELATED ART

The early attempts at improving the accuracy of an archery bow generally recognized the need of having the arrow pass through the center of the bow such as in the early U.S. Pat. No. 218,079 to Streeter. Another example is found in the much later U.S. Pat. No. 3,834,368 to Geiger as well as U.S. Pat. No. 3,698,375 to Brougham. Even Damron's arrow guidance system shown in his U.S. Pat. No. 4,027,645 involves an attempt at solving the inaccuracies that are inherent from the fact that the arrow must usually pass along one side or the other of the bow rather than through its center. Probably the best example of an effort to concentrate the force along the line of flight of the arrow can be found in the late U.S. Pat. No. 4,343,286 to Thacker.

Handles for gripping the bow are old in the art as evidenced by the previously-mentioned Streeter patent and his earlier one, U.S. Pat. No. 213,851. These handles together with Geiger's are fixed as is the one shown in Huntley's U.S. Pat. No. 3,132,651. On the other hand, the handle ahown in Scrobell, U.S. Pat. No. 3,599,621, as well as the previously-referred to patent to Thacker are movable relative to the bow. Even centered handles are commonplace as evident from the U.S. Pat. No. 2,900,973 issued to Diehr.

Arm and hand protectors are, likewise, well known in the prior art, an example being found in Crest's U.S. Pat. No. 3,623,468. Even combination handles and forearm protectors are well known, Geiger, Scrobell and Thacker, all having them.

By far the most pertinent prior art known to applicant is found in the Scrobell and Thacker patents. Scrobell has his combination forearm guard and handle attached to the bow for movement both about a horizontal axis perpendicular to the longitudinal axis of the bow and a second axis substantially parallel to the latter. The bow is free to pivot from side-to-side about the vertical axis which is also the axis of the handle, the latter being underneath the arrow and vertically disposed relative thereto. Moreover, his forearm protector goes over the top of the forearm not alongside of it. The horizontal pivot permits the bow to tilt fore and aft and it, together with the vertical one, are intended to cooperate with one another and isolate the hand action as transmitted to the handle from its effect upon the bow. It would appear, however, that the handle and arm protector assembly would have to be swung to one side about its vertical axis of pivotal movement when the arrow is released in order for the bowstring to pass alongside the archer's arm.

Even more pertinent is the Thacker patent where the forearm protector lies in position alongside the forearm between the latter, the arrow and the bowstring as it moves forward. On the other hand, instead of confining the movement of the handgrip and forearm protector to one or more fixed axes relative to the bow, it is attached to the latter by completely flexible connectors whose points of attachment with the limbs extending above and below the opening through which the arrow passes are aligned in the same plane with the arrow itself. Thus, while the points of pull on the front of the bow limbs always remain in alignment with the arrow, the handgrip and arm protector are free to move from side-to-side and even twist relative to the latter due to the presence of the chain-like flexible connections.

SUMMARY OF THE INVENTION

The combination handgrip and forearm protector of the present invention is adjustably mounted for limited hinged movement from side-to-side about a single fixed axis of pivotal movement closely paralleling the plane defined by the bowstring and the longitudinal axis of the bow. This same hinge axis is tiltable a few degrees while remaining parallel to the aforementioned plane to accommodate different shooting styles. The handle portion in contrast to the prior art ones, extends laterally out to the side of the bow on which the arrow is nocked. It is also rearwardly inclined at an angle of approximately 45° which places the hand gripping it in an attitude such that the force exerted against the bow lies close to the hinge pin axis thus minimizing the pressure the forearm protector exerts against the forearm of the shooter. The handle or handgrip and forearm protector also cooperate with one another to prevent the forearm of the shooter from rotating as well as being injured.

The pivotal connection accommodates any thickness of clothing worn by the shooter and does so by permitting the angle between the protector and the plane of the bow axis and bowstring to change. While a bumper is provided on the inner end of the handle in position to seat against an opposed surface on the side of the bow, it does not come into play while shooting and the handle and associated forearm protector remain free to seek a self-aligned position in which the thrust of the arm holding the bow essentially parallels the line of flight of the arrow in close proximity thereto. Moreover, this same pivotal connection is effective to prevent any torque from being transferred to the bow in a direction to twist same about its longitudinal axis by the hand holding it.

It is, therefore, the principal object of the present invention to provide a novel and improved combination handgrip and forearm protector for use on an archery bow.

A second objective is the provision of a device of the type aforementioned which is readily adaptable to most existing bows.

An additional object of the invention herein disclosed and claimed is that of providing an apparatus for attachment to an archery bow which protects the forearm of the shooter while, at the same time and even more importantly, significantly contributing to the accuracy attainable by even the average archer.

Another object is to provide a combination handgrip and forearm protector for an archery bow which cooperate with one another to prevent the forearm of the arm holding the bow from rotating while simultaneously self-adjusting to accommodate different size forearms and the clothing covering them.

Still another object is the provision of a unit of the class described which is self-aligning and operative to place the thrust of the arm holding the bow in closely adjacent parallelism with the intended line of flight of the arrow, all without allowing any torque to be applied to the bow in a direction to twist it about its longitudinal axis.

Further objects are to provide an accessory for use with an archery bow which is simple to install, requires no instruction in its use, is compact, lightweight, versatile, inexpensive, rugged, safe and even decorative.

Other objects will be in part apparent and in part pointed out specifically herein after in connection with the description of the drawings that follows.

DESCRIPTION OF THE PREFERRED EMBODIMENTS

Figure 1:
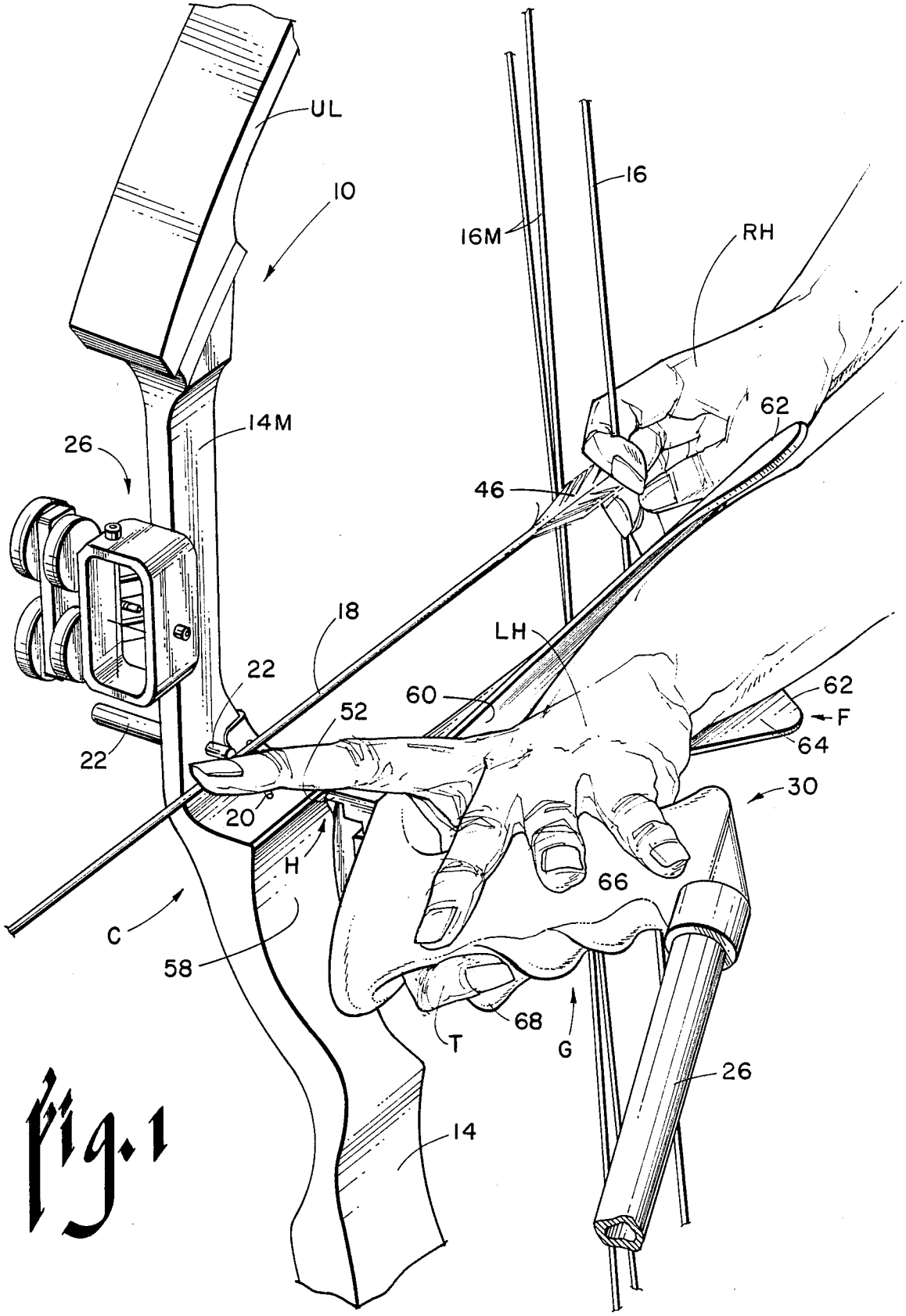
FIG. 1 is a fragmentary perspective view showing the improved archery bow of the present invention being held by the left hand of a right-handed archer preparatory to drawing the bowstring and releasing the arrow.

Referring next to the drawings for a detailed description of the present invention, and initially to FIG. 1 thereof, reference numeral 10 has been chosen to broadly designate an archery bow of the compound type having upper and lower limbs, only upper limb UL of which is shown. Both of these limbs cooperate when interconnected in spaced-apart relation by a connecting member that has been referred to in a general way by reference letter C that bridges the gap between them to define a longitudinal axis which lies in coplanar relation with the bowstring 16 that is connected by laterally offset cables 16M reaved between pulley-carrying portions (not shown) located in slots at the remote ends of these limbs which increase the mechanical advantage in a well known manner and thus permit the archer to exert a greater pull. The connecting member C includes a laterally offset portion 14M located at the center of the bow that leaves an opening along its longitudinal axis for the passage of arrow 18. In the particular form illustrated, an arrow rest 20 depends from this offset portion 14M and projects into the open pathway for the arrow in position to support same from the underside as shown. An adjustable post 22 is also carried by the offset portion 14M of the connector C and it projects laterally into the arrow-passage pathway in position to engage the side of the arrow as it sits atop rest 20 thus holding the arrow away from the side of the offset in centered relation on the longitudinal axis of the bow. A conventional crosshair-type sight indicated in a general way by reference numeral 24 has also been shown attached to the offset portion 14M projecting into the arrow-passage pathway in position above the arrow and the elements 20 and 22 that locate the latter. Most, if not all, of the aforementioned elements or their functional counterparts are found in the modern compound bow as is the so-called "stabilizer rod" 26 seen in FIGS. 1, 2 and 4.

Figure 3:
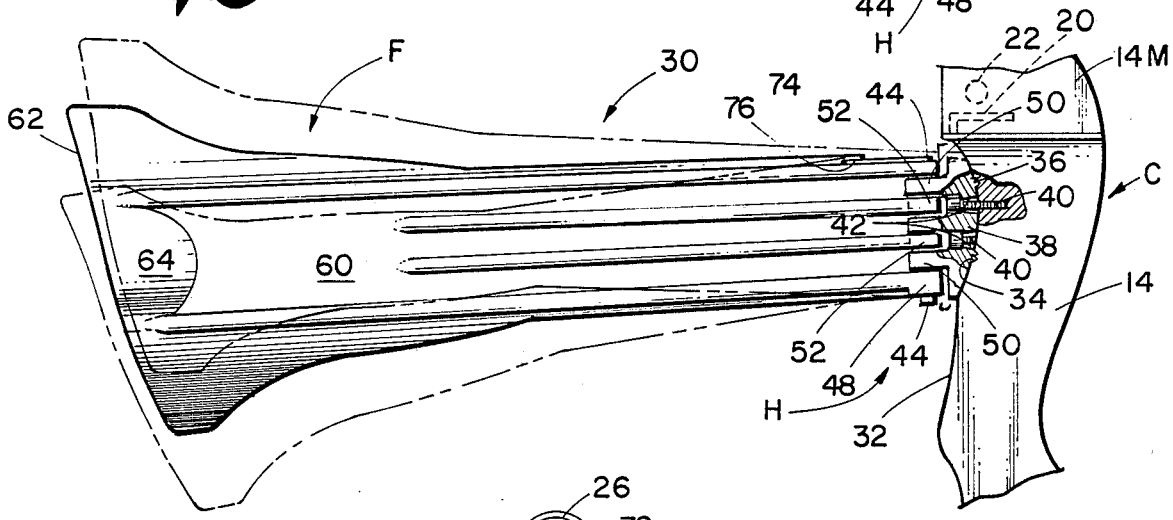
FIG. 3 is a fragmentary elevational view to the same scale as FIG. 2 showing the construction by means of which the combination handgrip and forearm protector can be tilted up or down to accommodate different shooting styles, portions having, once again, been broken away to more clearly reveal the internal construction; and, FIG. 4 is a front elevation to the same scale as FIGS. 2 and 3 showing the combination handgrip and forearm protector by itself with emphasis on that portion of the handgrip containing the thumb-hold projection.

The novelty resident in the present invention lies in the combination handgrip and forearm protector which is pivotally attached to the axially-aligned portion 14 of the connector C and which has been designated in a general way by reference numeral 30, the latter being shown in all four figures of the drawings to which detailed reference will now be made. In the particular form shown, and as most clearly seen in FIG. 3, the axially-aligned portion 14 of the connector has its rear edge 32 cut out, arcuately-curved and provided with an occasional tooth as seen at 34 at a position adjacent to and directly beneath the offset portion 14M thereof. This arcuate tooth-carrying cutout receives the complementary curved and toothed surface 36 of leaf 38 that form a part of a hinge member that has been broadly designated by reference letter H. A pair of bolts 40 received in oversize holes 42 in hinge leaf 38 screw into the aligned section 14 of connector C as seen in FIG. 3. Oversize bolt-receiving holes 42 permit the hinge leaf 38 to be adjusted up or down a few degrees each way in which adjusted position the toothed portions interengage and thus maintain the combination member 30 pivotally attached thereto by hinge pin 44 tilted from its medial position shown in full lines in FIG. 3 toward one or the other of its phantom line positions. The reason for this is that the hand drawing the bowstring (right hand RH as shown in FIG. 1), generally draws the fletched end 46 of the arrow 18 back to a point adjacent to and alongside the archer's chin. If this is the style used by the archer, the leaf 38 of hinge member H is secured to the connector C in its medial position so that the combination member hingedly connected thereto extends rearwardly in the full line position shown in FIG. 3. On the other hand, some archers pull the arrow back to a position alongside their nose instead of their chin which means that the bow will tilt forwardly and the forearm-protecting portion of the combination member 30 which has been broadly designated by reference letter F will need to be lowered if the bow is to be returned to its level condition by the left arm (LF) and hand (LH) of the user. To do so, of course, requires that leaf 38 of hinge H be raised up a few degrees before being tightened by bolts 40 against the arcuately-curved tooth-carrying surface 34 of the connector portion 14. Conversely, if the shooter is in the habit of drawing the arrow back to a location underneath his or her chin, the opposite adjustment is called for.

Figure 2:
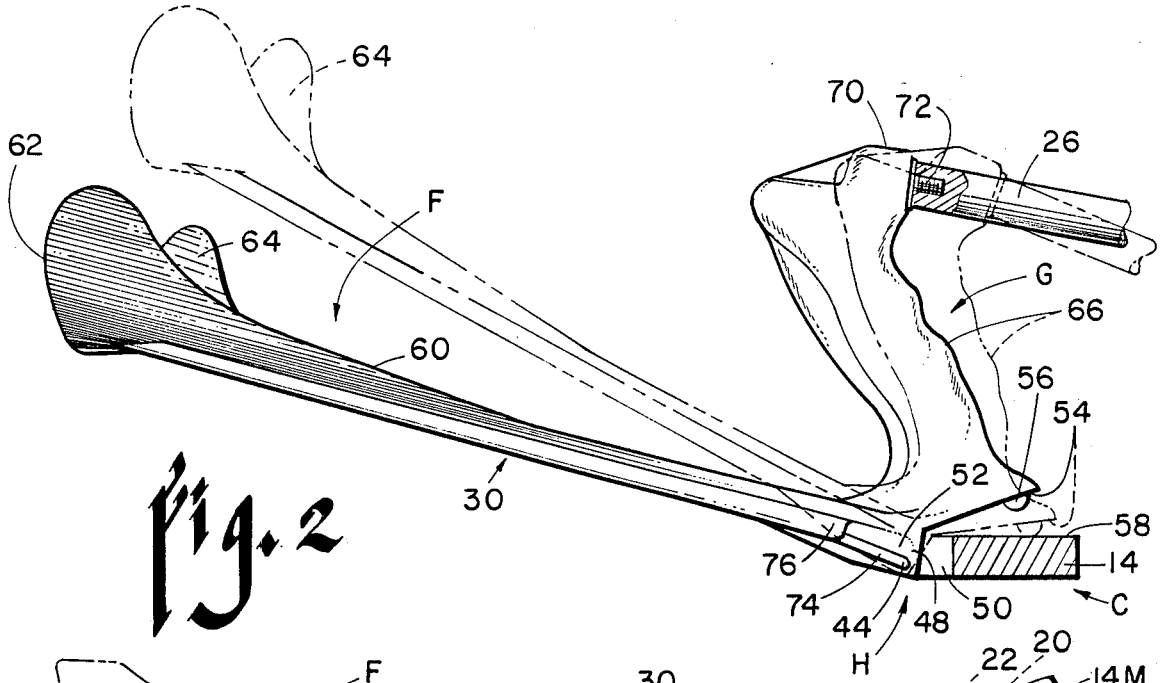
FIG. 2 is a fragmentary sectional view to a somewhat reduced scale showing in full and phantom lines how the combination handgrip and forearm protector self-adjusts to accommodate archers with different sizes of forearms and more or less clothing covering same, portions having been broken away to more clearly reveal the interior construction.
Figure 4:
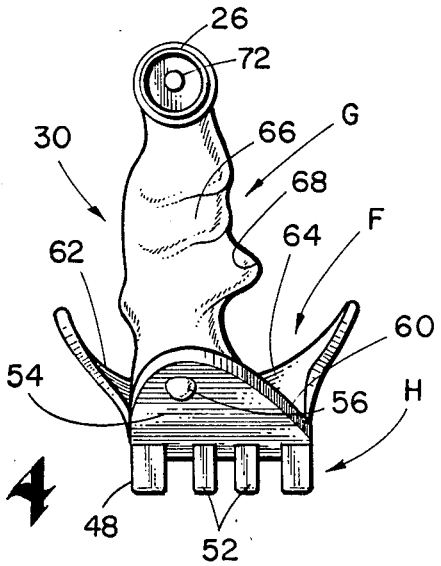

Looking particularly at FIGS. 2, 3 and 4, it can be seen that the other leaf 48 of hinge H is formed integral with the combination member 30 at the apex of the acute angle formed between the forearm-protecting portion F and the handgrip generally referred to by reference letter G. In the particular form illustrated, leaves 38 and 48 comprise a plurality of alternately interlocking tongues 50 and 52, respectively, that are held together by hinge pin 44. This hinge pin, regardless of its tilt forward or back, lies closely adjacent and parallel to the plane defined by the longitudinal axis of the bow, the bowstring 16 and, of course, the arrow 18. Also, once adjusted and the connection between hinge leaf 38 and aligned portion 14 of the connector C is tightened, the hinge pin defines a fixed axis of pivotal movement about which the combination forearm protector and handgrip swings between approximately the full and phantom line positions in which it is shown in FIG. 2, all of which are on the opposite side of the arrow and bowstring from the offset portion 14M of the connector member C.

The portion 54 located at the inner end of the handgrip G and which projects forwardly beyond the hinged connection H, carries a rubber bumper 56 which, when the bow is turned on its side and permitted to fall away from the forearm-protecting portion F of the combination unit, will contact and engage the opposed abutment-forming surface 58 of connector portion 14, all of which have been most clearly revealed in phantom line in FIG. 2. It is significant to note that abutment-forming surface 58 never contacts bumper 56 when the bowstring is drawn and the arrow is ready to be released. Instead, these elements are out of contact with one another and all elements of the assembly have reached a state of equilibrium including the arms and hands of the archer which move together as a unit as the arrow is directed toward the target. In other words, opposed surfaces 54 and 58 are so angled relative to one another that in any normal position required to launch the arrow, bumper 56 will not contact the abutment-forming surface 58. The sole purpose for these elements is, therefore, to limit the angular spread permitted between the bow and the combination unit to approximately that indicated by phantom lines in FIG. 2.

Now, it is significant to note in connection with FIGS. 1, 2 and 4 that the handgrip portion G of the combination unit projects out laterally from the hinge pin axis instead of parallel thereto so that the archer's hand gripping the latter is oriented essentially "palm down and forward". In FIGS. 1 and 2, it can also be seen that the handgrip G is angled rearwardly so as to form an acute angle of approximately 45° with respect to its companionpiece, the forearm-protecting portion F. While this angle is not especially critical, it does accomplish more than one worthwhile objective. To begin with, by so angling the handgrip, the archer's left hand (LH) as shown, is bent at the wrist such that the hand, wrist and forearm can, and usually do, all rest snugly against the opposed surface 60 of the forearm protector. On the other hand, if, for example, the handgrip was in right-angular relation to the forearm protector, the latter would have to be shaped to fit each individual user or else have the only areas of contact those of the hand with the handgrip and the protector with the forearm at some point spaced well back of the wrist.

Another reason for this acute-angular relation between the forearm protector and the handgrip as well as the laterally-extending aspect of the latter is shown in FIG. 1 where the index finger of the hand holding the bow is in position to be extended upwardly and inwardly where it can hold the arrow down against its rest 20 as well as inwardly against stop 22 until the moment of release. A lesser acute angle would, obviously, swing the index finger farther away from the bow, whereas, a vertically-extending handgrip as opposed to a laterally-extending one would take the finger even farther out of position to engage and hold the arrow.

By far the most important aspect of the angular relation between the handgrip and forearm protector is that of directing the forces produced by the hand and forearm of the shooter as he or she draws the bowstring along a line paralleling and closely adjacent to the line of intended flight of the arrow toward the target. More specifically, when properly held, almost all of the force exerted by the hand against the handgrip is concentrated at the apex of the angle formed between the latter and the forearm protector rather than out at the free end of the handgrip where the heel of the hand is located. As such the force applied is directed parallel to the plane defined by the longitudinal axis of the bow, the bowstring and, of course, the arrow at a point displaced to one side thereof only a matter of a half inch or so. Thus, the force applied to the handgrip closely adjacent the hinge pin axis defines with the latter a very short lever arm of only a half inch or so which lever arm functions to force the forearm protector which is almost a foot long against the shooter's forearm. The net result of this is that the pressure felt on the forearm is minimal having been reduced by a factor of ten or more times from that applied to the handgrip. If, on the other hand, the pressure against the handgrip were to be applied by the heel of the hand several inches from the hinge pin axis, then the pressure against the forearm would be increased severalfold since the mechanical advantage would be reduced down to only about 4:1.

Another equally important factor results from the fact that the torque applied to the handgrip by a right-handed archer such as that shown in FIG. 1 is clockwise as viewed from above. On the other hand, the force applied by the shooter's forearm against the protector F is counterclockwise and these two counteracting forces balance one another out to establish a state of equilibrium in which the combination unit made up of the handgrip and protector lies somewhere between the full and phantom-line positions of FIG. 2 when the bowstring is drawn and the arrow is ready to be launched. It is significant to realize that the aforesaid equilibrium position is achieved regardless of how thick or thin the shooter's forearm happens to be or how much or how little clothing is stuffed between it and the adjacent surface 60 of the protector. In other words, wearing heavy clothing does nothing more than shift the protector farther away from the phantom-line seated position of FIG. 2 and closer to the full line one without in any way disturbing the equilibrium condition.

The shape of forearm-contacting surface 60 is probably most clearly revealed in FIGS. 2 and 4 where it will be seen to be essentially flat and planar beginning at the apex and extending well back toward the rear end 62 where it is shown substantially widened and curved to provide a concave contour 64 adapted to more or less fit the forearm of the user just forward of the elbow. Other shapes could, of course, be used for the protector including one specifically contoured to the shooter's arm. Functionally, all do or would do the same thing provided that they hold the forearm away from the bowstring and, in addition, cradle the forearm and wrist.

FIGS. 1 and 4 both reveal a unique feature in terms of the contouring of the handgrip to fit the bow-holding hand LH of the shooter. In addition to the more or less conventional contouring of the grip to fit the fingers as seen at 66, a rounded knob or projection 68 is provided on the underside of the grip in the area adjacent the thumb T. The purpose of this projection or thumbhold is to provide a means for grasping the handgrip with the thumb when the fingers are extended or loose in the manner shown in FIG. 1 which is the preferred style of most archers as opposed to gripping the handgrip with a closed fist. By curling the thumb around this projection in the manner shown in FIG. 1 a secure grip is assured even with the rest of the hand open and even tilted farther to the right than the position shown in FIG. 1.

FIG. 1 alone reveals yet another significant advancement in those combination units designed to protect the shooter's forearm while, at the same time, providing the handgrip by means of which one holds onto the bow, namely, the cooperative relationship between these two elements which prevents the forearm from being rotated relative to the hand at the wrist joint. Once the hand and forearm are in place as shown in FIG. 1, it is virtually impossible to turn the forearm when the bowstring is drawn and the shooting arm held straight. This is a feature of significant importance in terms of accurate shooting since it takes away one of the variables that is oftentimes responsible for poor form and the attendant failure to hit the target where the arrow is aimed.

One or two other features should be mentioned briefly and the first is the use of the free end 70 of the handgrip as a convenient point of attachment for the stabilizer 26, the one shown having been screwed onto the threaded section of bolt 72 in the manner seen in FIGS. 1, 2 and 4. Other similar stabilizers are often attached to the bow at other locations such as, for example, the limbs and to the aligned portion 14 of the connector C beneath the arrow.

The other feature is the right-angled extension 74 of the hinge pin 44 which latches beneath the overhanging latch 76 molded into the forearm-protecting portion of the combination unit 30 on the same side thereof as the arrow. The only reason for this is to prevent the hinge pin from coming out and being lost.

What is claimed is:

1. An archery bow comprising: upper and lower limbs defining a longitudinal axis and having adjacent ends thereof spaced apart to leave a gap therebetween; a bow string interconnecting the remote ends of said upper and lower limbs; connecting means including upper and lower axially-aligned portions connecting said upper and lower limbs together so as to bridge the gap therebetween and a laterally-offset portion intermediate said axially-aligned portions defining an axially-aligned opening for the passage of an arrow; and, means comprising a combination handgrip means and forearm protecting means pivotally attached to said lower axially-aligned portion of said connecting means for limited relative pivotal movement about a fixed axis paralleling and closely adjacent said longitudinal axis, said forearm protecting means including rigid brace-forming means extending rearwardly from said axis of pivotal movement in the direction of said bowstring and on the opposite side thereof from said laterally-offset portion of said connecting means, said brace-forming means being shaped and dimensioned to define a protective surface for positioning between the forearm of the archer's arm holding the bow by means of the handgrip means and the bowstring, said handgrip means extending laterally in laterally-offset relation to said axis of pivotal movement and in rearwardly-inclined acute-angular relation to said forearm protecting means while cooperating therewith when grasped with the archer's bow-holding hand palm-down to prevent rotation of said archer's forearm as the bowstring is drawn and the arrow released, and said forearm protecting means and handgrip means further cooperating to cause the archer's hand and forearm in engagement therewith to automatically thrust the bow in a direction closely paralleling the flight of the arrow an the bow, arrow, bowstring and hand drawing the latter are permitted to pivot freely relative to said bow-holding hand and associated handgrip means and forearm protecting means as the arrow is aligned with its target.

2. The archery bow as set forth in claim in which: the pivotal connection between the lower axially-aligned portion of the connecting means and the combination handgrip means and forearm protecting means is adjustable in the plane of the longitudinal axis to enable the archer to change the tilt of the brace-forming means relative to the arrow in order to accommodate different shooting styles; and in which means interconnecting said lower axially-aligned portion and said combination are provided for locking the latter in adjusted position.

3. The archery bow as set forth in claim 1 in which: an arrow rest in the form of a ledge defined by the juncture between said lower axially-aligned portion and axially-offset portion of the connecting means is positioned and adapted to support an arrow resting thereupon within the axially-aligned opening; and, in which the handgrip means of the combination handgrip means and forearm protecting means is so positioned and angled adjacent to and underneath said arrow rest that the index finger of the archer's bow-holding hand can extend over the top of an arrow seated atop said rest and hold said arrow against the latter until released.

4. The archery bow as set forth in claim 1 in which: opposed stop-forming means are provided on the handgrip means and lower axially-aligned portion of the connecting means positioned and adapted to engage one another to limit the angular separation permitted between the bowstring and forearm protecting means when the bow is turned upon its side and released to drop freely away from and down underneath the latter.

5. The archery bow as set forth in claim 1 in which: the axis of pivotal movement of the combination handgrip means and forearm protecting means is positioned approximately at the apex of the angle formed therebetween.

6. The archery bow as set forth in claim 1 in which: the axis of pivotal movement is offset on the side of opposite the longitudinal axis opposite to the laterally-offset portion of the connecting means.

7. The archery bow as set forth in claim 1 in which: the handgrip means and forearm protecting means are so angled relative to one another and positioned relative to their common axis of pivotal movement such that the archer's hand and forearm in operative engagement therewith establish counterrotational forces that cancel one another out and establish a state of equilibrium around which the bow, bowstring, and arrow together with the hand drawing the latter are free to swing relative thereto as a unit as they are brought into alignment with the target.

8. The archery bow as set forth in claim 1 in which: a thumb-hold projects from the underside of the handgrip means positioned and adapted for the thumb of the hand holding the bow to grasp as a means for holding on thereto without having to use the fingers.

9. In an archery bow having spaced apart upper and lower limbs axially-aligned to define a longitudinal axis, connecting means including a laterally-offset portion bridging the gap between said upper and lower limbs while cooperating therewith to define an axially-aligned passage for the flight of an arrow, and a combination handgrip means and forearm protecting means beneath said laterally-offset portion for pivotal movement along a longitudinal axis relative thereto, the improvement which comprises: extending said handgrip means along a generally lateral axis from one side of said axis of pivotal movement and extending said forearm protecting means rearwardly in acute angular relation from said handgrip means, said handgrip means when grasped by the archer's hand palm-down cooperating with said forearm protecting means to provide offsetting counterrotating forces effective to hold said forearm protecting means against the forearm of said archer's bow-holding hand, the aforesaid counterrotating forces being in equilibrium with one another so as to leave said bow free to pivot independently of said combination when so held.

10. In an archery bow having spaced apart upper and lower limbs axially-aligned to define a longitudinal axis, connecting means including a laterally-offset portion bridging the gap between said upper and lower limbs while cooperating therewith to define an axially-aligned passage for the flight of an arrow, and a combination handgrip means and forearm protecting means pivotally attached to said connecting means beneath said laterally-offset portion, the improved adjustable hinged connection between said combination handgrip means and forearm protecting means and said connecting means which comprises: a three-part hinge having two leaves and a hinge pin, one of said leaves being formed integral with said combination handgrip means and forearm protecting means while the other of said leaves is separate from said connecting means, said other of said leaves and connecting means having complementary surfaces arcuately curved about an axis perpendicular to said longitudinal axis which permit said other of said leaves to be tilted relative to said connecting means for adjusting the tilt of the forearm protecting means; and, means interconnecting said connecting means and said other hinge leaf for maintaining the adjusted position therebetween.

11. The archery bow as set forth in claim 10 in which: the hinge pin includes a laterally-extending projection; and, in which a portion of the combination handgrip protecting means and forearm protector adjacent the axis of pivotal movement of the latter includes a latch-forming means positioned and adapted to receive said projection when swung into engagement therewith, said projection and latch-forming means cooperating when so interengaged to releasably latch the hinge pin in place within the hinge leaves.

* * * * *